US006672785B1

(12) United States Patent
O'Hara et al.

(10) Patent No.: US 6,672,785 B1
(45) **Date of Patent: *Jan. 6, 2004**

(54) INSERT FOR A COIL BOUND NOTEBOOK

(75) Inventors: Kate M. O'Hara, Dayton, OH (US); Bobby G. James, Jr., Miamisburg, OH (US)

(73) Assignee: MeadWestvaco Corporation, Stamford, CT (US)

( * ) Notice: Subject to any disclaimer, the term of this patent is extended or adjusted under 35 U.S.C. 154(b) by 188 days.

This patent is subject to a terminal disclaimer.

(21) Appl. No.: 09/711,582

(22) Filed: Nov. 13, 2000

(51) Int. Cl.[7] ..... B42F 13/00
(52) U.S. Cl. ..... 402/79; 402/57; 402/73; D19/26; D19/33
(58) Field of Search ..... 402/57, 58, 73, 402/79, 502; D19/26, 27, 33

(56) References Cited

U.S. PATENT DOCUMENTS

| | | | | |
|---|---|---|---|---|
| 717,957 | A | 1/1903 | Weaver | |
| 792,747 | A | 5/1905 | Anderson et al. | |
| 818,130 | A | 4/1906 | Swan | |
| 852,871 | A | 5/1907 | Cohn | |
| 868,758 | A | 10/1907 | Bexell | |
| 1,107,351 | A | 8/1914 | Proudfit | |
| 1,156,160 | A | 10/1915 | Lewis | |
| 1,371,459 | A | 3/1921 | Amlie | |
| 2,093,041 | A | 9/1937 | Emery | 129/1 |
| 2,153,575 | A | 4/1939 | Kramer | |
| 2,681,655 | A | 6/1954 | Schade | 129/1 |
| 2,848,163 | A | 8/1958 | Van Horne Serrell | |
| 2,904,900 | A | 9/1959 | Kramer | 35/55 |
| 3,719,161 | A * | 3/1973 | Wegner | 116/240 |
| 4,193,704 | A | 3/1980 | Miller et al. | 402/19 |
| 4,430,015 | A | 2/1984 | Nerlinger | 402/79 |
| 4,551,039 | A | 11/1985 | Basseches | |
| 4,636,179 | A | 1/1987 | Gentile et al. | |
| 4,645,237 | A | 2/1987 | Squire et al. | 281/47 |
| 4,699,538 | A | 10/1987 | Caine | |
| 4,907,905 | A | 3/1990 | Fournier | |
| 4,940,353 | A | 7/1990 | Osono et al. | |
| 5,015,114 | A | 5/1991 | Miller | |
| 5,033,899 | A | 7/1991 | Pitts et al. | 402/80 R |
| D319,260 | S | 8/1991 | Dubaj | D19/32 |
| 5,066,046 | A | 11/1991 | Hoopingarner | |

(List continued on next page.)

OTHER PUBLICATIONS

Attachment A, European sample with three snap–in tabs and divider tabs; date unknown; admitted to be prior art for the limited purpose of consideration of this reference as prior art in the prosecution of this application; applicant reserves the right to challenge the status of this reference ad prior art.
Attachment B, bound–in kraft paper pocket dividers; date unknown; admitted to be prior art for the limited purpose of consideration of this reference as prior art in the prosecution of this application; applicant reserves the right to challenge the status of this reference as prior art.
Attachment C, Snap–in planner ruler from DayRunner; date unknown; admitted to be prior art for the limited purpose of consideration of this reference as prior art in the prosection of this application; applicant reserves the right to challenge the status of this reference as prior art.

*Primary Examiner*—Monica Carter
(74) *Attorney, Agent, or Firm*—Thompson Hine LLP

(57) ABSTRACT

An insert for being coupled to coil, the insert comprising a piece of sheet-like material having an inner edge and a plurality of wings. Each wing has a central stem extending outwardly from the inner edge and a pair of tip portions located on opposed sides of the central stem. Each tip portion extends inwardly toward the inner edge to define a coil receiving portion located between the stem and the associated tip portion. Each coil receiving portion is shaped and located to receive a turn of the coil therein to couple the insert to the coil.

7 Claims, 7 Drawing Sheets

U.S. PATENT DOCUMENTS

| | | | | | |
|---|---|---|---|---|---|
| D325,928 | S | | 5/1992 | Bourgeois | D19/27 |
| 5,234,277 | A | | 8/1993 | Le | |
| 5,405,169 | A | | 4/1995 | Schwartz | |
| 5,433,480 | A | | 7/1995 | Gresham et al. | 281/17 |
| 5,433,546 | A | | 7/1995 | Kershaw | |
| 5,476,336 | A | | 12/1995 | Osiecki et al. | 402/79 |
| 5,480,192 | A | | 1/1996 | Angerbauer et al. | 281/31 |
| 5,489,120 | A | | 2/1996 | Thornsburg | |
| 5,511,661 | A | * | 4/1996 | Karlis et al. | 206/338 |
| 5,524,998 | A | | 6/1996 | Schwartz | 402/79 |
| D375,758 | S | | 11/1996 | Osiecki et al. | D19/32 |
| 5,572,815 | A | * | 11/1996 | Kovner | 40/404 |
| 5,590,972 | A | | 1/1997 | Shobin | 402/79 |
| 5,597,256 | A | | 1/1997 | Burton et al. | |
| D384,102 | S | | 9/1997 | Osiecki et al. | D19/32 |
| 5,669,726 | A | | 9/1997 | Karlis et al. | 402/4 |
| 5,695,294 | A | | 12/1997 | Bedol et al. | 402/79 |
| 5,704,724 | A | | 1/1998 | Karlis et al. | 402/79 |
| 5,709,496 | A | | 1/1998 | Werner et al. | |
| 5,727,894 | A | | 3/1998 | Covey | |
| D393,483 | S | | 4/1998 | Covey | D19/32 |
| 5,771,598 | A | | 6/1998 | Lassberg | 33/494 |
| 5,806,677 | A | | 9/1998 | Storti | |
| 5,836,711 | A | | 11/1998 | Stewart | 402/79 |
| D404,424 | S | | 1/1999 | Covey | D19/32 |
| 5,887,900 | A | | 3/1999 | Raymond | 281/22 |
| 5,909,979 | A | | 6/1999 | Winzen | |
| 5,915,873 | A | | 6/1999 | Karlis | 402/79 |
| 5,924,736 | A | | 7/1999 | Russo | 281/38 |
| D427,632 | S | | 7/2000 | McNeil | D19/33 |
| 6,082,612 | A | | 7/2000 | Black | |
| 6,086,281 | A | | 7/2000 | Covey | |
| 6,135,662 | A | | 10/2000 | Bakke et al. | |
| 6,193,065 | B1 | | 2/2001 | Salomone | |
| D442,631 | S | * | 5/2001 | Pfanner et al. | D19/27 |
| 6,249,391 | B1 | | 6/2001 | Hayakawa et al. | |
| 6,390,713 | B1 | * | 5/2002 | Moor et al. | 281/15.1 |

* cited by examiner

INSERT FOR A COIL BOUND NOTEBOOK

The present invention is directed to an insert for a notebook, and more particularly, to an insert that can be removably coupled to a coil bound notebook.

BACKGROUND OF THE INVENTION

Coil bound notebooks are often used by students, professionals and other users to provide paper and writing surfaces for notes, homework assignments, sketches and the like. The papers bound in the notebooks may be used as part of the notebook, or removed for standalone use. The notebook may also include a plurality of tab dividers, pockets, pouches, or other organizational features for receiving loose papers or other items, and typically include a wire or plastic coil that binds the papers, covers, pockets, dividers, and other components of the notebook together. In this manner, a coil bound notebook is a versatile, flexible tool which can serve as an organizer, storage device, paper dispenser and writing tablet.

In a typical coil bound notebook, the various components are permanently bound together by a binding coil, which permanently fixes the location of the components. In order to provide greater flexibility, dividers and other notebook components having a quick-attach feature have been developed, which enables the component to be releasably coupled to the coil. This provides the notebook with a customization ability; that is, the various components of the notebook can be coupled to the coil at any desired location through the thickness of the notebook. However, existing quick-attach features either do not securely hold the component into the coil, or are difficult to remove from the coil. Accordingly, there is a need for an insert for a coil bound notebook which can be securely yet releasably received in the coil.

SUMMARY OF THE INVENTION

The present invention is an insert for being coupled to a coil bound notebook which is securely coupled to the coil, yet can be easily removed. In one embodiment, the invention is an insert for being coupled to coil, the insert comprising a piece of sheet-like material having an inner edge and a plurality of wings. Each wing has a central stem extending outwardly from the inner edge and a pair of tip portions located on opposed sides of the central stem. Each tip portion extends inwardly toward the inner edge to define a coil receiving portion located between the stem and the associated tip portion. Each coil receiving portion is shaped and located to receive a turn of the coil therein to couple the insert to the coil.

Other objects and advantages of the present invention will be apparent from the following description and the accompanying drawings.

DETAILED DESCRIPTION

Figure 1:
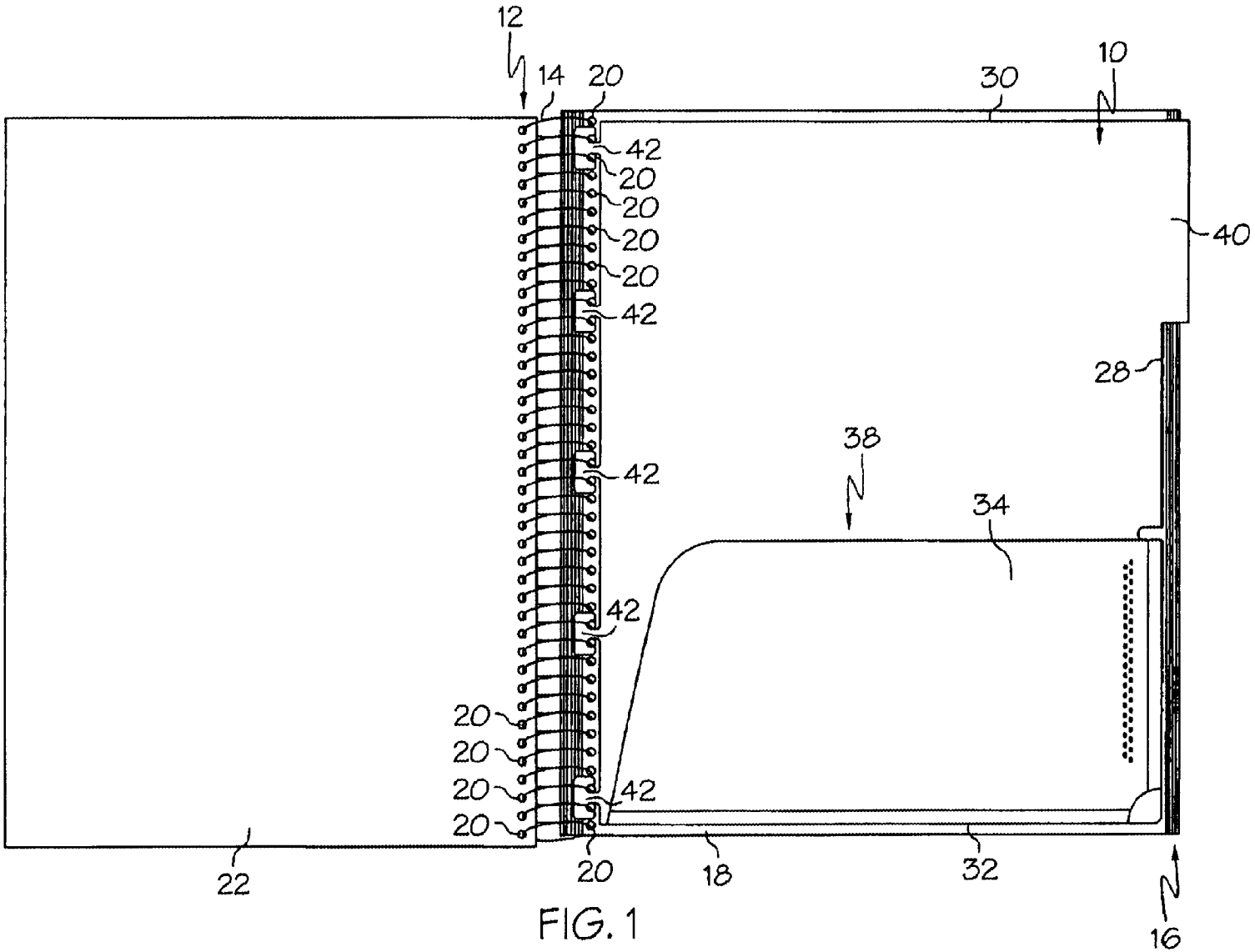
FIG. 1 is a top view of a notebook with a notebook insert of the present invention received therein.

As shown in FIG. 1, the insert of the present invention, generally designated 10, is a tab divider shaped to be received in a notebook 12 having a coil 14 or other similar coil binding mechanism. The notebook 12 includes a plurality of papers 16, each paper having a plurality of binding holes 20 formed therein. For example, top paper 18 includes a plurality of binding holes 20 visible in FIGS. 1 and 4. Each binding hole 20 receives a turn of the coil 14 to bind the papers 16, 18 to the coil. The notebook preferably has a front cover 22 and a rear cover (not shown), as well as other pockets, dividers and other components (not shown) spaced throughout the thickness of the notebook 12. Each of the components typically includes a plurality of binding holes 20 to bind the component to the coil 14.

Figure 2:
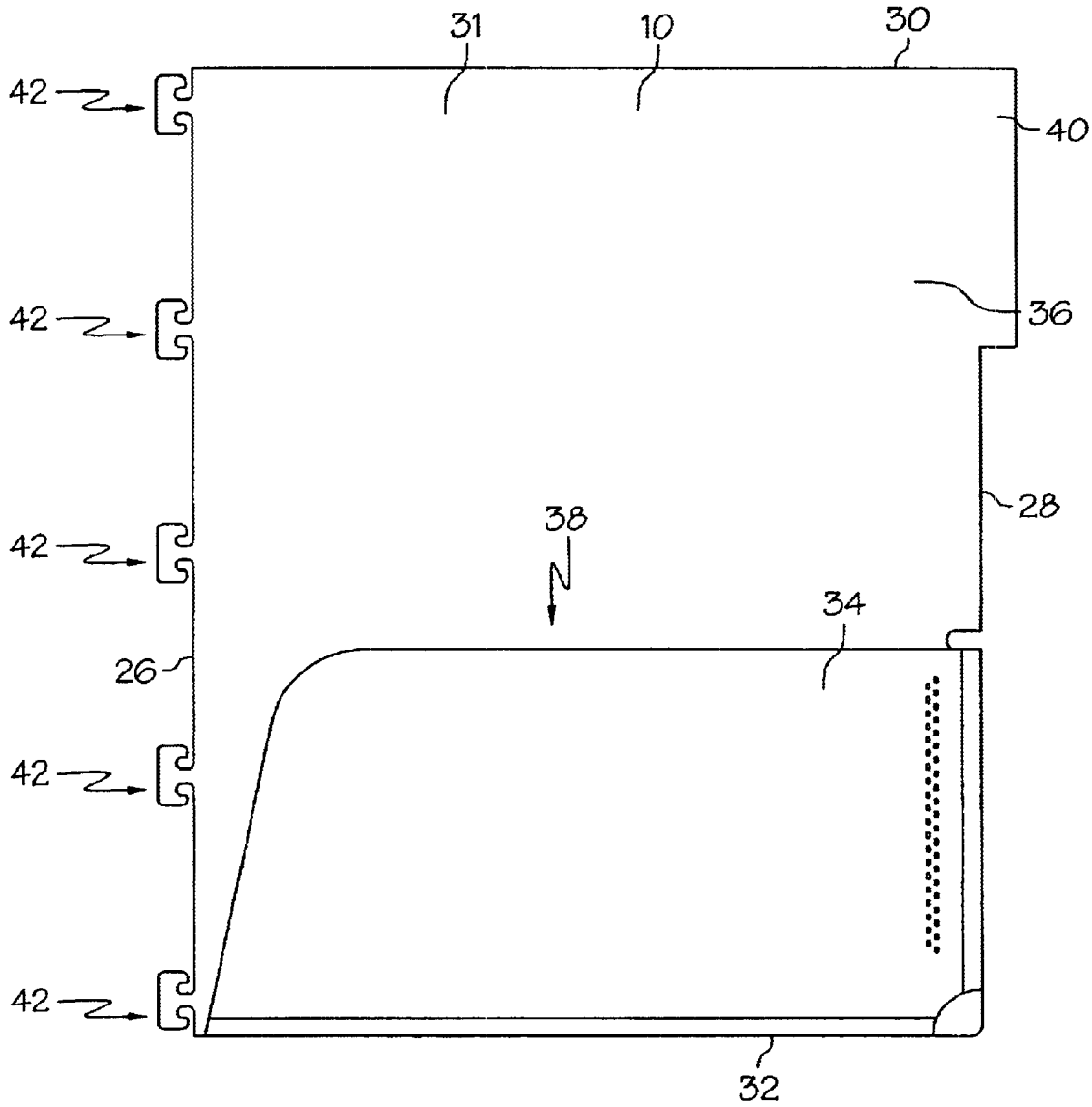
FIG. 2 is a front view of the insert of FIG. 1.
Figure 3:
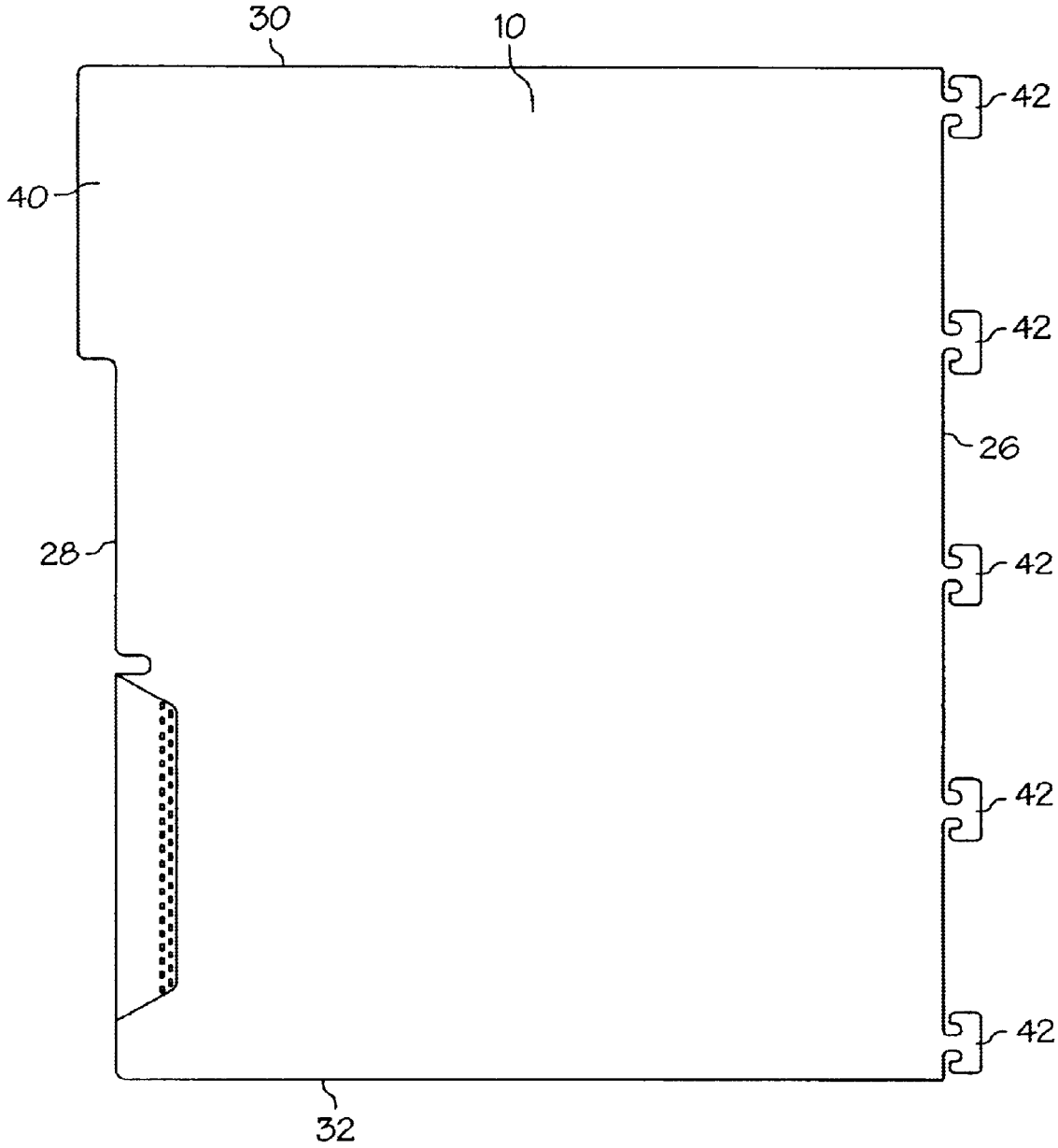
FIG. 3 is a back view of the insert of FIG. 2.

As best shown in FIGS. 2–3, the tab divider 10 includes inner 26, outer 28, top 30 and bottom 32 edges, and is preferably made of cardboard, plastics, polypropylene, or other materials. The tab divider 10 preferably includes a lower panel 34 attached to its front face 31. The lower panel 34 and main panel 36 form a pocket 38 therebetween for receiving papers and other loose items. The tab divider 10 may also include a tab portion 40 extending outwardly from the outer edge 28 to serve as a locator/identifier. The tab portion 40 can be located at various locations along the length of the outer edge 28, as desired, to form a tab locator system with other tab dividers.

Figure 4:
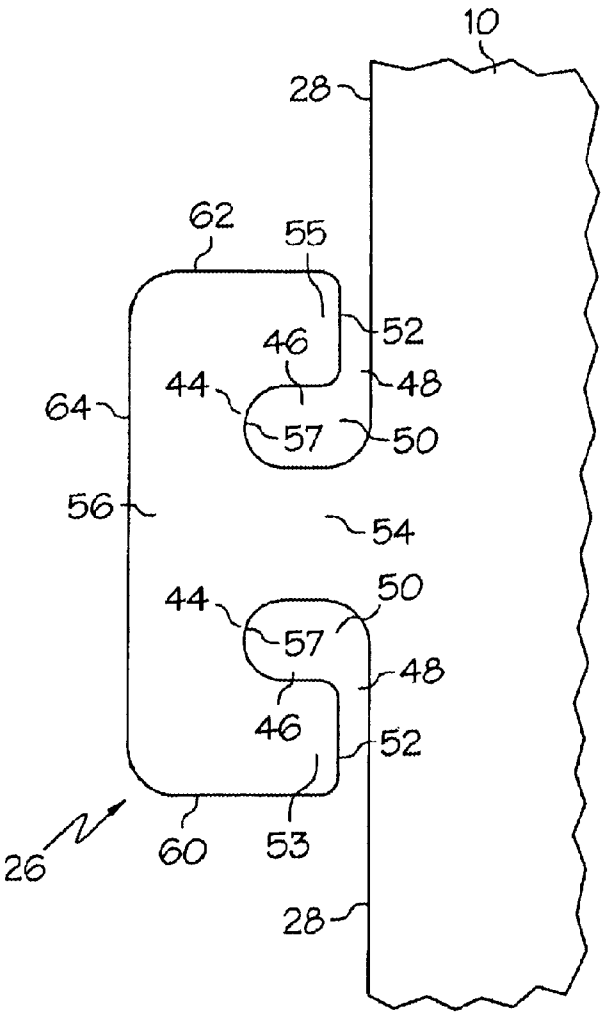
FIG. 4 is a detail view of a wing of the insert of FIG. 2.

The tab divider 10 includes a plurality of wings 42 extending generally outwardly from the inner edge 26 of the tab divider. As shown in FIG. 4, wing 26 is generally rectangular in top view, and includes a pair of coil receiving portions 44, each coil receiving portion 44 having a coil receiving opening 46 formed therein. Each coil receiving opening 46 has a throat portion 48 and an inner portion 50. Each inner portion 50 is generally circular in top view and is shaped and located to receive the turn of a coil 14 therein to couple the tab divider 10 to the coil 14. The diameter of each inner portion 50 is preferably smaller than the diameter of the binding holes 20 of any adjacent components that increase the surface area and strength of a wing.

Each throat portion 48 is shaped and located to enable a turn of the coil 14 to be passed therethrough and be received in the associated inner portion 50. Each throat portion 48 extends generally parallel to the inner edge 52 of the tab wing 26 and the inner edge 28 of the tab divider 10. Each throat portion 48 is preferably a "channel" defined by a narrow opening between the inner edge 52 of the wing 26 and the inner edge 28 of the tab divider 10. However, the throat portion 48 may simply be a slit cut in the divider (i.e. in this case the inner edges 52, 28 are immediately adjacent or in contact). When the throat portion 48 is a slit, it is simply a cut in the material of the divider 10, and no material is removed. However, in this case the edges of the slit throat portion may be deformed when the turns of a coil are passed through the throat portion 48, which can be unsightly and may catch papers thereon. Accordingly, the illustrated "channel" throat portion 48 is preferred.

Each wing 26 includes a central stem 54 that extends generally outwardly from the inner edge 28 of the tab divider 10, and a crown portion 56 that extends generally transverse to the central stem 50. The crown portion 56 includes a pair of indentations 57, which define the inner portions 50 of the coil receiving openings 46, each indentation 57 being located on opposed sides of the stem 54. Each wing includes a pair of tip portions 53, 55 that extend from the crown portion 56 toward the inner edge 26 of the tab divider 10. The tip portions 53, 55 define the coil receiving portions 44 located between the tip portions 53, 55 and the central stem 54. The tip portions 53, 55 help to maintain a turn of the coil 14 in the associated coil receiving openings 46

The wing 26 includes an inner edge 52 that extends generally parallel to the inner edge 28 of the tab divider 10, a pair of side edges 60, 62 that extend generally perpendicular to the inner edge 28, and an outer edge 64 that extends generally parallel to the inner edges 52 of the wing. The wing 26 includes rounded corners at the intersections of the side edges 60, 62 and the inner 52 and outer 64 edges of the wing to prevent the wings from "catching" on the coil 14 or papers 16. The indentations 57 and coil receiving openings 46 are also preferably defined by curved edges to reduce interference between the wings 26 and the coil 14 and papers 16.

In order to couple the tab divider 10 to the coil 14, the wing 26 is deflected such that a turn of the coil 14 (i.e., turn 68 of FIG. 5) is passed through the throat portion 48 and received in the associated inner portion 50 of the associated coil receiving opening 46. Similarly, the other end of the wing 26 is then deflected such that turn 70 is received through the associated throat portion 48 and received in the associated inner portion 50 of the associated coil receiving opening 46. The same procedure is repeated for the remaining wings 26 to attach the tab divider 10 to the coil 14. The sequence of operations is reversed to decouple the tab divider 10 from the coil.

It should be understood that by the term "turn" of a coil, it is meant any length of the coil which is received through a binding hole 20 of a paper 16, 18 or coil receiving opening 46 of a wing 20. For example, in some coils, each turn may be comprised of two or more parallel, closely spaced wires.

The throat portion 48 of each coil receiving opening 46 is preferably wide enough to allow easy insertion and removal of at least one turn of the coil 14, but is small enough to not compromise the strength of each wing 26. The number of wings 26 may be increased or decreased as desired, although it has been found that five wings as shown in FIGS. 1–3 is preferred for use with a standard size notebook.

Figure 5:
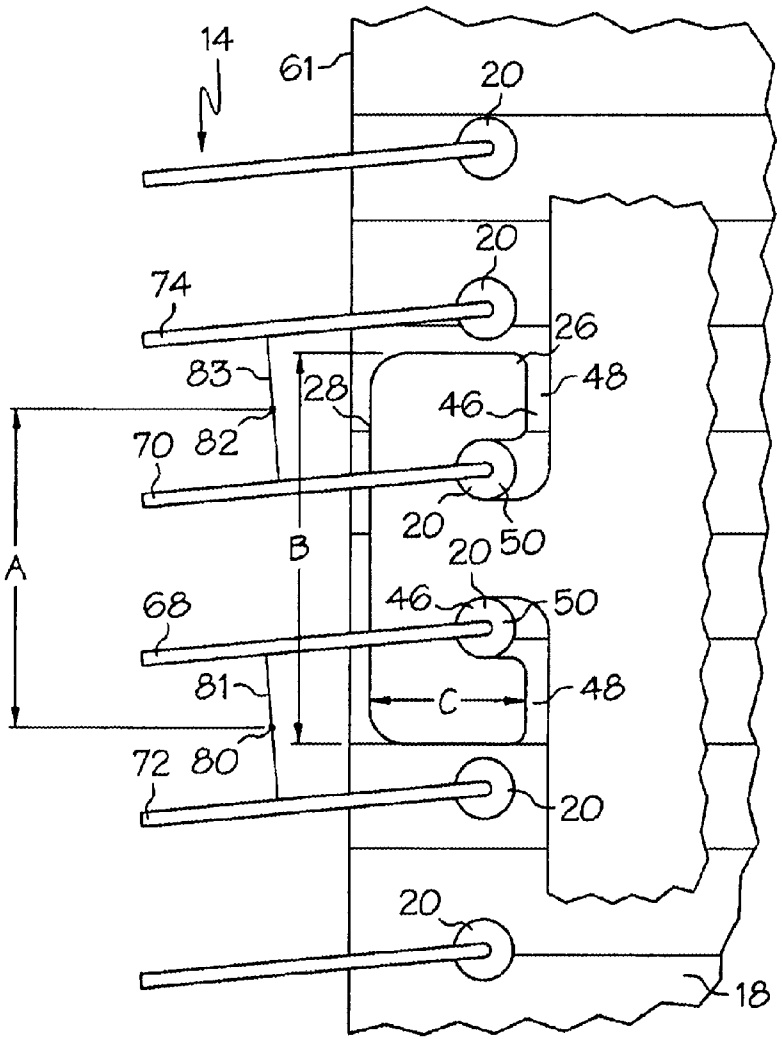
FIG. 5 is a detail view of the wing of FIG. 4 mounted to the coil of a coil bound notebook.

As shown in FIG. 5, two (preferably adjacent) turns 68, 70 of the coil 14 are received in each wing 26. A distance A extends between the mid-point 80 of adjacent turns 68 and 72 and the mid-point 82 of adjacent turns 70 and 74. By the term "midpoint" it is meant the midpoint of an imaginary line 81 drawn between the turns 68, 72 and perpendicular to the turns 68, 72, and the midpoint of an imaginary line 83 drawn between the turns 70, 74 and perpendicular to the turns 70, 74. The length B of each wing 26 is preferably greater than the distance A, but of course shorter than the distance between turns 72 and 74. This length B of the wing 20 provides a large surface area and strength to the wing 26, and helps prevent the wing from being pulled out from the coil 14 when external forces are applied to the tab divider 10. Furthermore, because the length B is shorter than the distance between turns 72 and 74, the wing does not interfere with the papers or other components of the notebook.

The width C of the tab divider 26 is preferably selected such that the inner edge 28 of the tab divider 26 does not extend beyond the inner edge 61 of any adjacent papers 16, 18. This ensures that the wings 26 do not interfere with the pages of the notebook 12 when the pages are turned in the notebook. Furthermore, as noted earlier, all corners of the wing 26 are preferably rounded off to prevent any sharp corners from interfering with the papers 16, 18 or coil 14, or from scratching the fingers of the user.

The wing connector system of the present invention can be utilized with nearly any component which is desired to be coupled to a notebook, including but not limited to rulers, pouches, dividers, pockets, protective covers, school supplies, other notebooks, papers, writing instruments, electronic devices, planners, reference cards and the like. The present invention enables the component, or insert, to be coupled to the notebook at any location through the thickness of the notebook. Thus, a user can move components having the wing connector system of the present invention to customize the notebook. Furthermore, components such as calculators, pouches, electronic devices, pockets and the like having the wing connector system of the present invention can be releasably coupled to the coil bound notebook such that the components can be used in a standalone mode, and then reattached to a coil bound notebook for storage.

Figure 6:
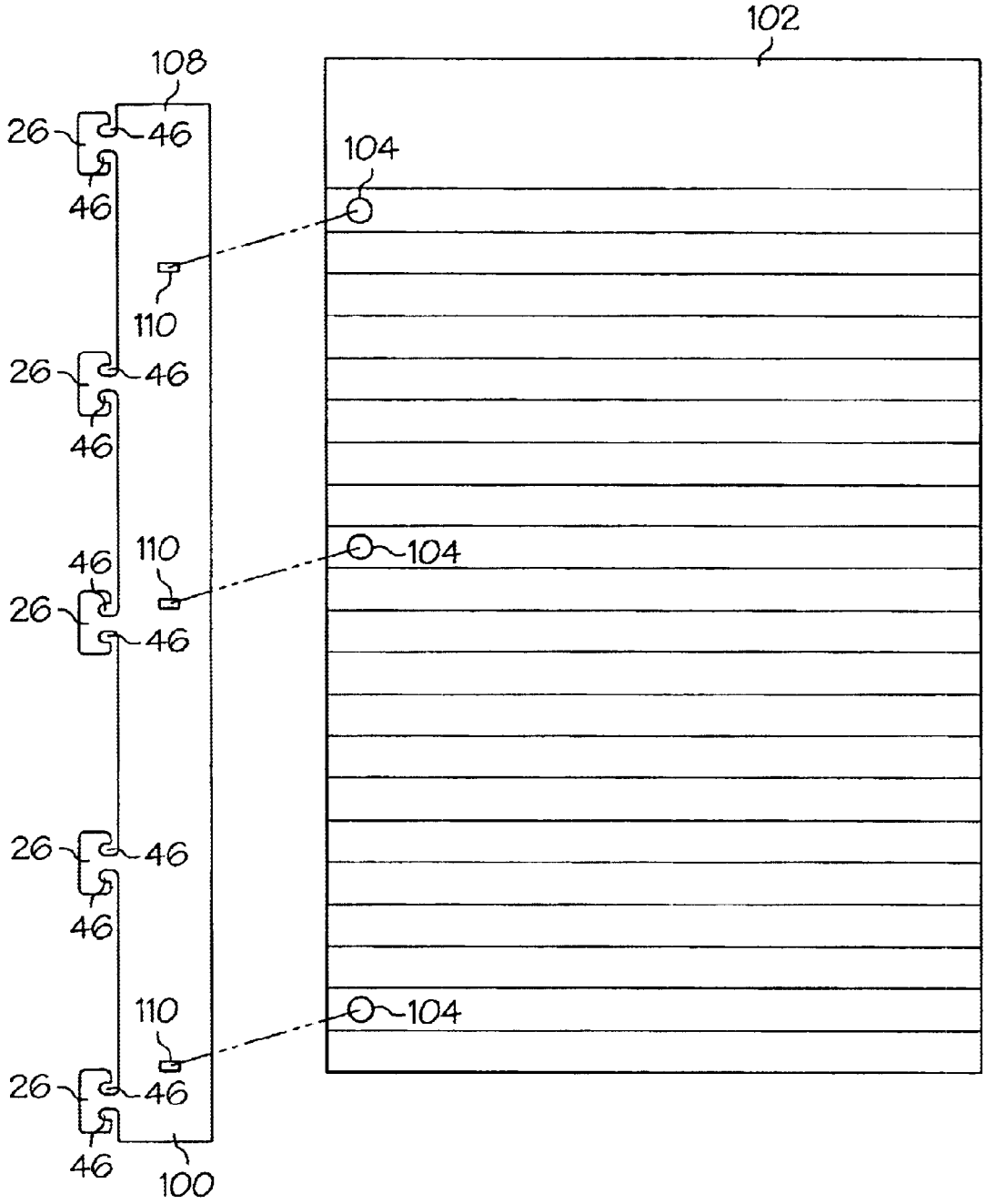
FIG. 6 is a top view of an adapter using the quick-attach feature of the present invention, shown in conjunction with a piece of paper.
Figure 7:
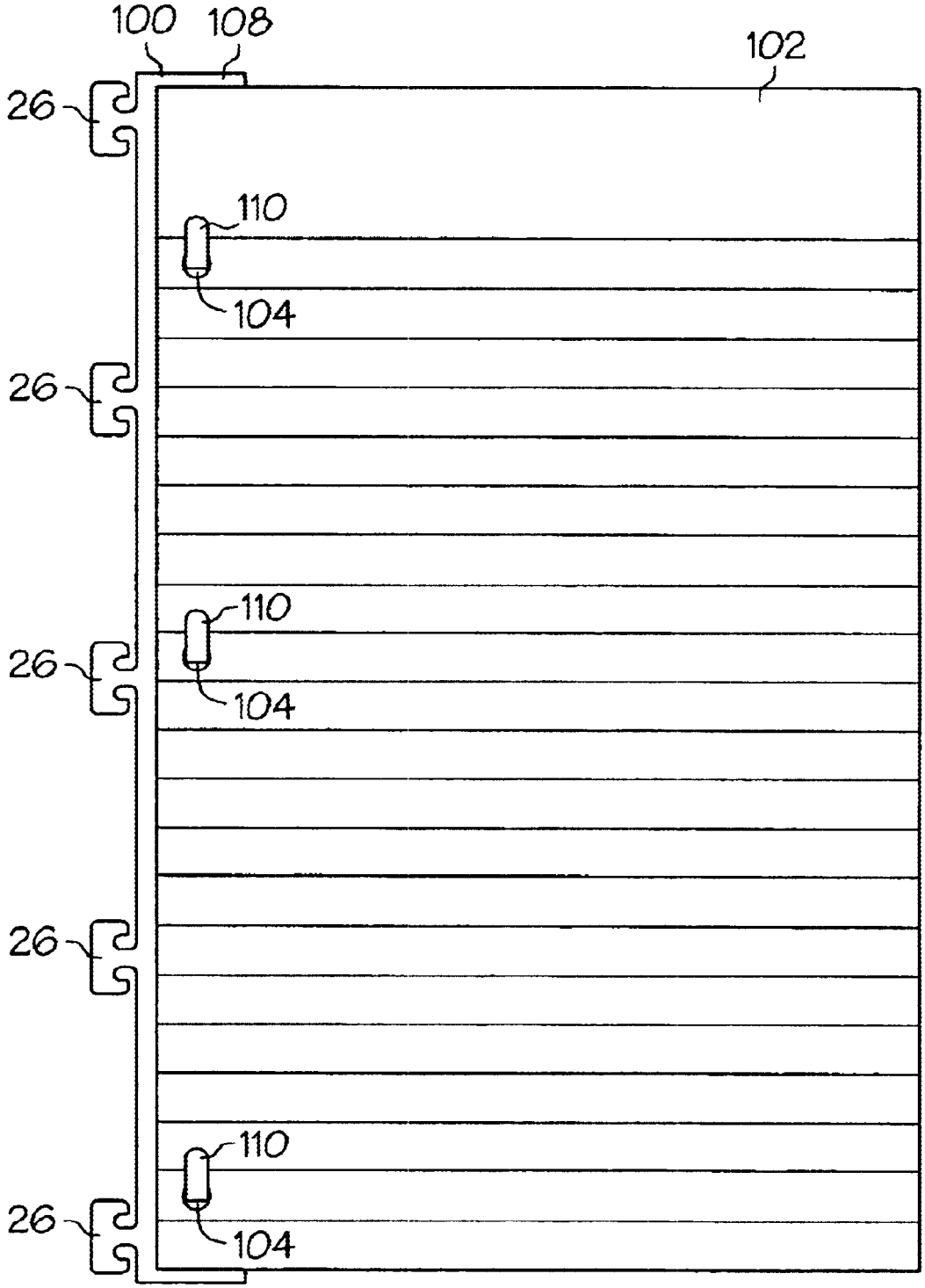
FIG. 7 is a top view of the adapter of FIG. 6 receiving the paper therein.

As shown in FIG. 6, the quick attach feature of the wing connectors 26 may be used with an adapter 100 for coupling a loose leaf paper 102 or papers having a plurality of holes 104 formed therein to a coil bound notebook. The holes 104 are typically located such that the paper 102 can be coupled to a three ring binder. The adapter 100 includes a strip of material 108 having a plurality of pliable prong components 110, each prong component being shaped and located to fit through an associated hole 104 in the paper 102, and deflected to couple the paper 102 to the adapter (see FIG. 7).

In order to couple a paper 102 or plurality of papers to the coil, the pliable prong components 110 are first folded to their upright position (FIG. 6), passed through a hole 104 of the paper 102, and then deflected such that each prong component lays flat over the top surface of the paper (FIG. 7) in a well known manner. The adapter 100 can then be coupled to the coil 14 in the same manner discussed above by fitting the wings 26 between adjacent turns of the coil such that each coil receiving opening 46 receives a turn therein. Of course, the sequence of operations may be reversed such that the adapter 100 is first coupled to the coil 144, and the paper(s) then coupled to the adapter.

Figure 8:
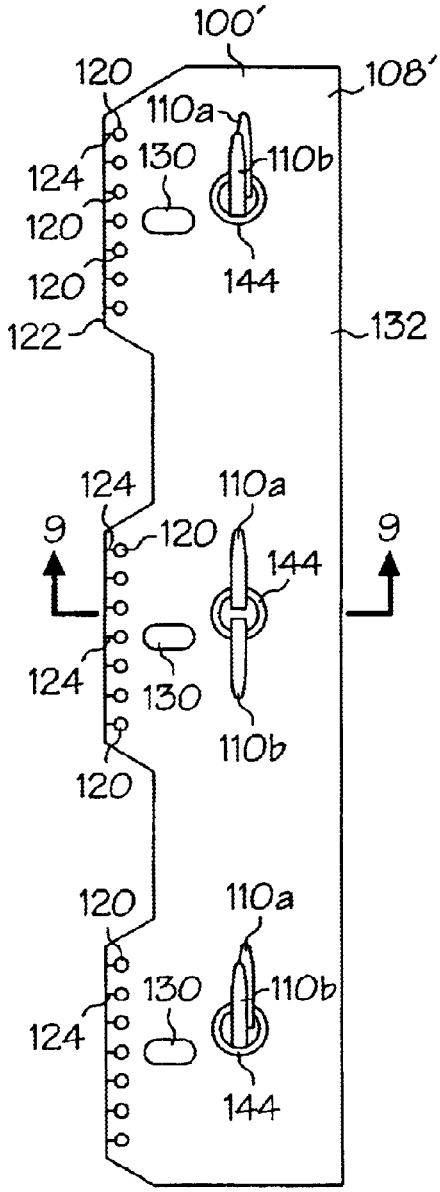
FIG. 8 is a top view of an alternate embodiment of the adapter of FIG. 6.

The adapter may include a variety of other quick-attach features for coupling the adapter to a coil beyond the quick-attach wing portions discussed above. For example, as shown in FIG. 8, the adapter 100' may include a plurality of openings 120 located adjacent an inner edge 122 of the strip of material 108', each opening 120 being shaped and located to receive at least one turn of a coil. The adapter 100' includes a plurality of slits 124, with each slit extending from the inner edge 122 of the adapter 100' to one of the openings 120 to enable a turn of a coil to be removably slid into, and received in, the associated opening 120. In this embodiment, each opening 120 is generally circular, and each slit 124 is a cut formed in the strip 108', although the slits 124 may also be a small strip of material removed from the strip 108' similar to the throat portion 48 of the wing connector system. The adapter 100' shown in FIG. 8 also includes a plurality of openings 130 extending through the adapter 100' for receiving the rings of a binder, such as three-ring binder, therethrough to couple the adapter to the binder. Furthermore, the adapter 100' may include a pair of prong components 110*a*, 110*b* that can be splayed in opposite directions to couple a paper 102 to the adapter 100'.

Figure 9:
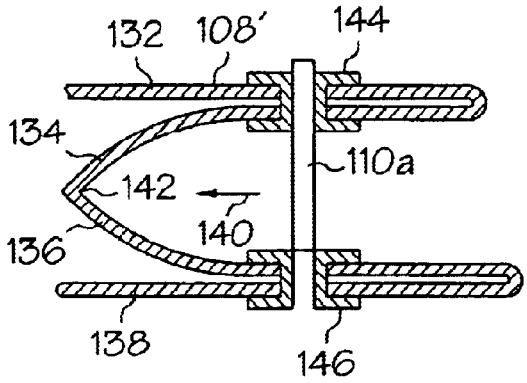
FIG. 9 is a side cross section taken along line 9—9 of FIG. 8.

As shown in FIG. 9, the adapter 100' may be a piece of material 108' folded over itself to form an upper, or first layer 132, a second layer 134, a third layer 136, and a bottom or fourth layer 138. The second layer 134 and third layer 136 form a V-shape having an opening 140 therebetween. A paper 102 can be received in the opening 140 such that the inner edge of the paper 102 is received in crease 142 and the prong components 110*a* and 110*b* passed through the holes 104 of a paper 102. The upper 132 and second 134 layers are connected by a rivet 144 having a central opening therein, and the third 136 and bottom 138 layer are connected by a rivet 146. The prong components 110*a*, 110*b* are coupled to the rivet 146, and extend through the central opening in rivet 144 such that they can be folded over the top layer 132.

In this manner, the adapter provides a mechanism for adding additional sheets to a coil bound notebook. In many prior art coil bound notebooks, once the originally bound papers of the coil bound mechanism are used and/or removed, the binder must discarded. The adapter provides a mechanism for adding additional paper to the coil bound notebook, thereby extending the useful life of a coil bound notebook.

Having described the invention in detail and by reference to the preferred embodiments, it will be apparent that modifications and variations thereof are possible without departing from the scope of the invention.

What is claimed is:

1. An insert for being coupled to a coil, the insert comprising a piece of sheet-like material having an inner edge devoid of any coil-coupling cutout and having a plurality of wings extending away from said inner edge, said inner edge and each wing completely defining a pair of coil receiving openings located between said wing and said inner edge, each coil receiving opening having a throat portion extending in a direction substantially parallel to the inner edge and having an inner portion, each inner portion having a cavity including a cavity entrance in communication with an associated throat portion and including a cavity bottom, wherein a distance from said inner edge to a tip portion is greater at said cavity bottom than at said throat portion, and each throat portion being shaped and located to allow a turn of said coil to be passed therethrough to be received in an associated inner portion to couple said insert to said coil.

2. The insert of claim 1, wherein the cavity has a substantially straight centerline axis which extends from the cavity bottom to the cavity entrance and which is disposed substantially perpendicular to said inner edge.

3. The insert of claim 2, wherein the cavity has a substantially "U" shape.

4. A notebook comprising:

a binding coil;

a plurality of sheets bound together by said binding coil; and an insert including a piece of sheet-like material having an inner edge devoid of any coil-coupling cutout and having a plurality of wings extending away from said inner edge, said inner edge and each wing completely defining a pair of coil receiving openings located between said wing and said inner edge, each coil receiving opening having a throat portion extending in a direction substantially parallel to the inner edge and having an inner portion, each inner portion having a cavity including a cavity entrance in communication with an associated throat portion and including a cavity bottom, wherein a distance from said inner edge to a tip portion is greater at said cavity bottom than at said throat portion, and each throat portion being shaped and located to allow a turn of said coil to be passed therethrough to be received in an associated inner portion to couple said insert to said coil.

5. The notebook of claim 4 wherein said coil includes at least first, second, third and fourth adjacent turns and a first midpoint located halfway between said first and second turns and a second midpoint located halfway between said third and said fourth turn, and wherein a length of each wing is longer than a distance between said first and said second midpoints.

6. The notebook of claim 5 wherein the length of each wing is shorter than a distance between said first turn and said fourth turn.

7. The notebook of claim 6 wherein each sheet includes a plurality of binding holes formed therein, each binding hole receiving a turn of said coil to bind said sheet to said coil, and wherein each coil receiving portion is a generally circular opening having a diameter smaller than a diameter of said binding holes.

* * * * *

UNITED STATES PATENT AND TRADEMARK OFFICE

CERTIFICATE OF CORRECTION

PATENT NO. : 6,672,785 B1
DATED : January 6, 2004
INVENTOR(S) : Kate M. O'Hara et al.

It is certified that error appears in the above-identified patent and that said Letters Patent is hereby corrected as shown below:

Column 6,
Line 38, "claim 6" should be -- claim 4 --

Signed and Sealed this

Twentieth Day of April, 2004

JON W. DUDAS
*Acting Director of the United States Patent and Trademark Office*